US005775266A

United States Patent [19]

Ziegler

[11] Patent Number: 5,775,266

[45] Date of Patent: Jul. 7, 1998

[54] STEAM GENERATOR

[75] Inventor: Georg Ziegler, Winterthur, Switzerland

[73] Assignee: Asea Brown Boveri AG, Baden, Switzerland

[21] Appl. No.: 621,643

[22] Filed: Mar. 26, 1996

[30] Foreign Application Priority Data

May 31, 1995 [EP] European Pat. Off. ..... 95810358

[51] Int. Cl.[6] ..... F22D 1/00

[52] U.S. Cl. ..... 122/7 R; 122/1 C; 122/4 D

[58] Field of Search ..... 122/4 D, 1 C, 122/1 A, 7 R

[56] References Cited

U.S. PATENT DOCUMENTS 4,160,009 7/1979 Hamabe ..... 122/4 D
4,466,241 8/1984 Inui et al. ..... 122/7 R

FOREIGN PATENT DOCUMENTS 3344712C 12/1983 Germany .
4218016A 2/1992 Germany .

OTHER PUBLICATIONS

Thomé-Kozmiensky, "Thermische Abfallbehandlung", EF-Velang für Energie—und Um Welttechnik GmbH, (2d Ed. 1994) pp. 555-557.

*Primary Examiner*—Henry A. Bennett
*Assistant Examiner*—Jiping Lu
*Attorney, Agent, or Firm*—Burns, Doane, Swecker & Mathis, L.L.P.

[57] ABSTRACT

In a steam generator (1) having, downstream of the fire-box (7), a radiant part and, subsequent thereto, a convective part, the latter essentially comprising, connected in series on the flue-gas side, contact heat exchanger (18), superheater (9) and economizer (2), the steam generator (1) being used in a circuit for the direct selective catalytic reduction (SCR process) of the nitrogen oxides in the flue gas (19), the economizer (2) consists of two parts. An NOx catalyst (5) is arranged between the two parts (2*a*, 2*b*), the economizer (2*a*) arranged upstream of the catalyst (5) in the direction of flow of the gas (19) being subdivided into at least two sections (10*a*, 10*b*), through which, on the one hand, the flow passes in series on the flue-gas side and, on the other hand, the working medium to be heated flows in parallel from bottom to top, and at least one section (10*a*) always being connected via lines (11*a*, 12) to the drum (13) and the other section(s) (10*b*) being able to be shut off as desired from the water circulation via lines (11*b*) which can be shut off.

10 Claims, 4 Drawing Sheets

STEAM GENERATOR

BACKGROUND OF THE INVENTION

1. Field of the Invention

The invention relates to a steam generator having, downstream of the firebox, a radiant part and, subsequent thereto, a convective part, the latter including, connected in series on the flue-gas side, contact heat exchanger, superheater and economizer, which is used for the direct selective catalytic reduction (SCR process) of nitrogen oxides (NOx) in the exhaust gas of refuse incineration plants, where the NOx catalyst is charged directly with the hot flue gases, i.e. is arranged in the circuit upstream of the scrubber.

2. Discussion of Background The NOx emissions from the thermal waste incineration plants may not exceed values specified by law. To decrease the NOx emissions, which are generally between 300 and 450 mg/m$^3$, it is known to use primary firing measures and/or more effective secondary measures on the exhaust-gas side, available secondary measures being the SNCR process (selective non-catalytic reduction) and the SCR process (selective catalytic reduction).

In the SNCR process, the NOx are reduced thermally, by the reducing agent (ammonia or urea) being injected into the firing compartment or boiler compartment in a temperature range from about 900° to 1100°C.

In the SCR process, in contrast, the nitrogen oxides are reacted at considerably lower temperatures, with addition of ammonia water, on a catalyst to give nitrogen and steam. According to the prior art to date, it is only possible to decrease the NOx emissions to values <100 mg/m$^3$ by a catalytic process.

According to the known prior art, various possibilities exist for the way in which the catalyst stage is connected. Thus, for example, boilers for refuse incineration plants are equipped with NOx catalysts which are usually used downstream of the scrubber. Although this has the advantage, on the one hand, that the risk of catalyst poisoning or blocking by dust and sulfur dioxide is reduced, on the other hand, it has the disadvantage that the flue gases must be reheated prior to entry into the catalyst.

Therefore, in more recent circuits, the NOx catalyst is provided upstream of the scrubber. It is then charged directly with the hot flue gases, so that it is not necessary to reheat the exhaust gas downstream of the scrubbing. If de-dusting is carried out in advance (direct low-dust circuit) to residual dust contents below 10 mg/m$^3$ (S.T.P.), the catalysts achieve service lives similar to those in circuits downstream of the exhaust-gas scrubber. However, the electrostatic precipitator of the de-dusting can also be arranged downstream of the NOx catalyst (direct high-dust circuit).

For optimum employment of the catalyst and as long a service life as possible, it is necessary to keep the gas temperature upstream of the NOx catalyst as constant as possible at a preset value, for example 350°C. The optimum operating temperature of the catalyst is 320° to 350° C. (K. J. Thomé-Kozmiensky: Thermische Abfallbehandlung [Thermal treatment of waste]. EF-Verlag für Energie- und Umwelttechnik GmbH, 2nd edition, 1994, pp. 555–557). This range can be still greater, depending on the catalyst used, e.g. a catalyst operating at a operating temperature of 280° C. in a refuse incineration plant is known.

Using the prior art known to date, however, an approximately constant gas temperature is not possible in the various operating states. Thus, for example, the gas temperature in a conventional refuse incineration plant boiler has the following values in two different operating cases:

| Operating case | Gas temperature in °C. downstream of | | |
|---|---|---|---|
| | Superheater | Evaporator | Economizer |
| Full load, dirty | 461 | 343 | 237 |
| Partial load, clean | 370 | 290 | 190 |

There are therefore considerable differences in the flue gas temperature (here approximately 50° C. downstream of the economizer), which has unfavorable effects in direct charging of the NOx catalyst with the hot flue gases.

SUMMARY OF THE INVENTION

Accordingly, one object of the invention is to provide a novel steam generator which avoids all these disadvantages and which can be used for SCR process circuits in which the NOx catalyst upstream of the scrubber is charged directly with the hot flue gases, the gas temperature upstream of the catalyst being able to be kept at an approximately constant preset value with relatively little expenditure. According to the invention this is achieved with a steam generator in which the economizer consists of two parts and an NOx catalyst is arranged between the two parts, the economizer upstream of the catalyst in the direction of flow of the gas being subdivided into at least two sections through which, on the one hand, the flow passes in series on the flue-gas side and, on the other hand, the working medium to be heated flows in parallel, at least one section always being connected via a line to the drum and the other section(s) being able to be shut off as desired from the water circulation via lines which can be shut off.

According to the invention this is achieved in a process for operating the steam generator by the temperature of the flue gases being measured immediately before their entry into the NOx catalyst and a number, dependent on this temperature, of the shut-off elements in the lines being closed. The water in these shut-off sections partly evaporates. The steam forces the remaining water out of the sections back into the feed line. By this means one or more sections of the pre-catalyst economizer are shut off from the water circulation and some of the heating surface becomes inactive.

The advantages of the invention are to be seen, inter alia, in that the gas temperature upstream of the NOx catalyst is relatively easy to control and, by ensuring an approximately constant impingement temperature, the NOx catalyst operates optimally and has a long service life. The invention can be employed both in direct low-dust and direct high-dust circuits, that is the electrostatic precipitator can be arranged either upstream or downstream of the economizer.

It is particularly expedient if the pre-catalyst economizer is designed to be of a size such that, in the operating case "full load, dirty", the entry temperature of the flue gas into the catalyst is less than or equal to the operating temperature of the catalyst.

In addition, it is advantageous if the components, such as superheater, protective bundle, outlet flues, in the boiler which are upstream of the pre-catalyst economizer are designed so that in the operating case "partial load, clean", the entry temperature of the flue gas into the pre-catalyst economizer is greater than or equal to the operating temperature of the catalyst.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for the understanding of the invention are shown. Items of the plant which are not shown are, for example, the boiler stoking, the firing system and the wet-scrubbing unit. The direction of flow of the operating medium is shown with arrows.

DESCRIPTION OF THE PREFERRED EMBODIMENTS

Figure 1:
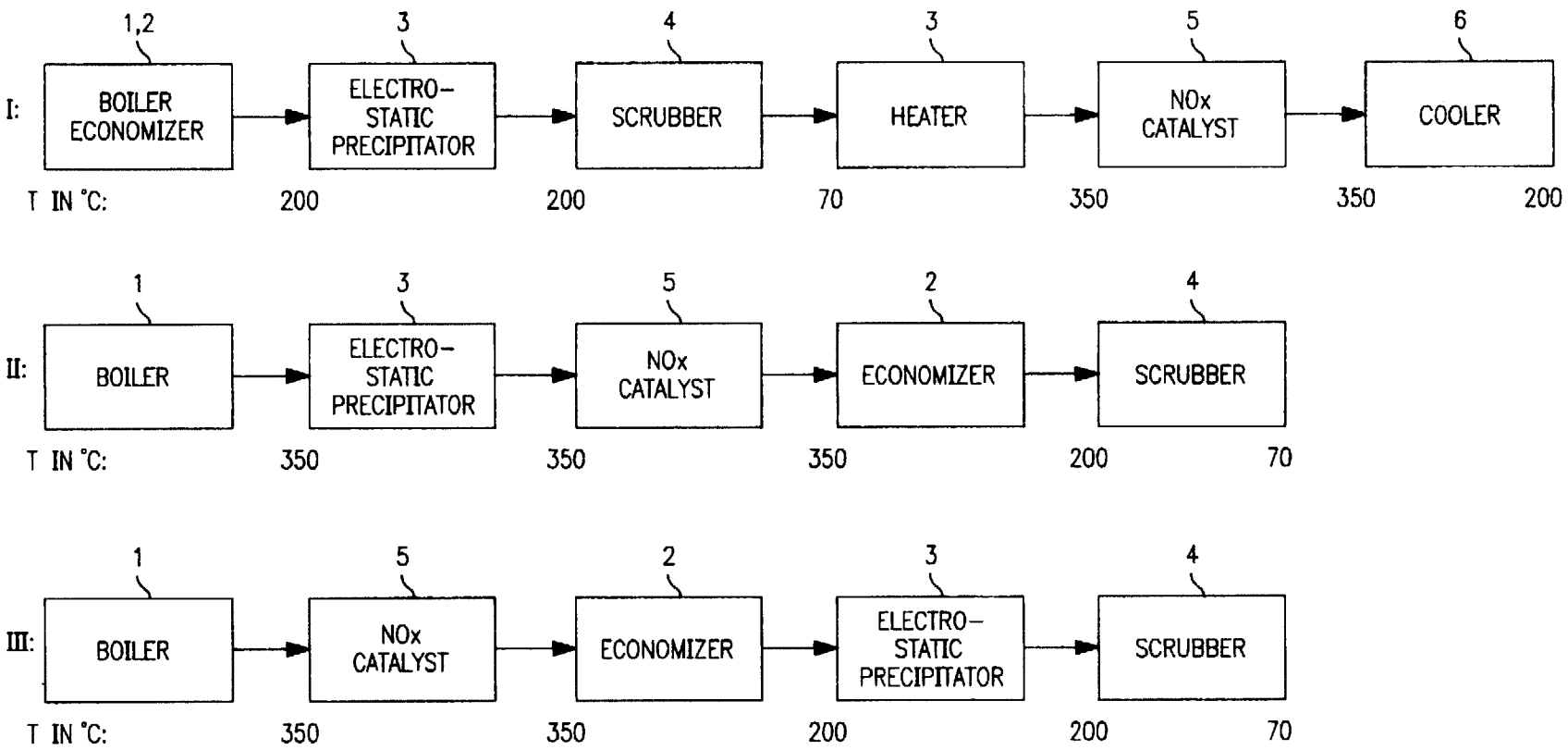
FIG. 1 PRIOR ART
FIG. 1 shows three circuit diagrams of refuse incineration plants having SRC processes according to the prior art I: conventional II: direct low-dust III: direct high-dust.

Referring now to the drawings, wherein like reference numerals designate identical or corresponding parts throughout several views, in FIG. 1 three SCR circuits known from the prior art are first shown, together with each of the gas temperature levels obtainable after the individual treatment steps. Part I shows a circuit in which the apparatuses boiler 1/economizer 2, electrostatic precipitator 3, scrubber 4, NOx catalyst 5 and cooler 6 are arranged in the order of flow through them, the gas, owing to the low flue gas temperature downstream of the scrubber 4 (e.g. 70° C.), having to be reheated (e.g. to 350° C.) prior to entry into the NOx catalyst 5. This heating is not necessary in the "low-dust" circuit shown in part II, in which the units are arranged in the order boiler 1, electrostatic precipitator 3, NOx catalyst 5, economizer 2 and scrubber 4, as is also the case in the "high-dust" circuit shown in part III with an arrangement in the order boiler 1, NOx catalyst 5, economizer 2, electrostatic precipitator 3 and scrubber 4.

Figure 2:
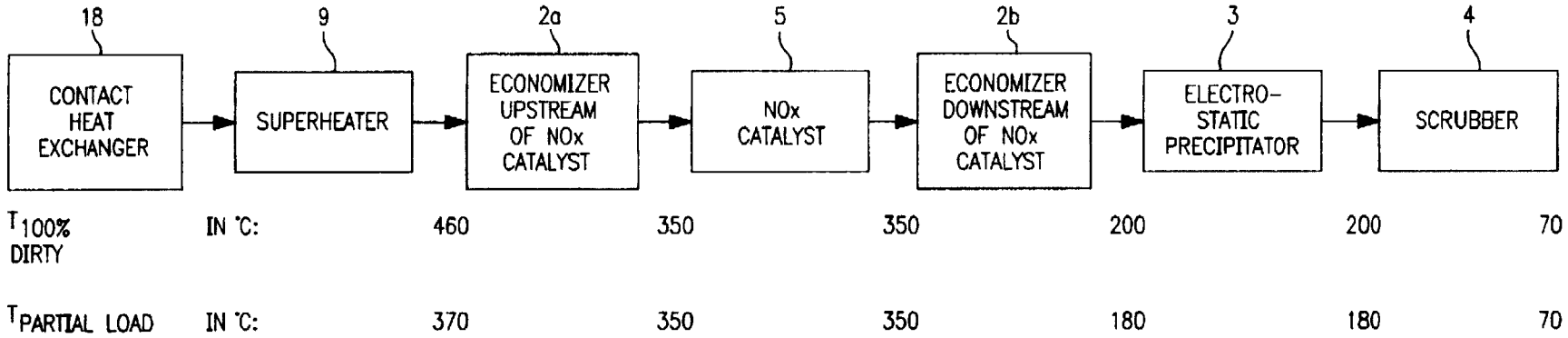
FIG. 2 shows the novel circuit diagram of a refuse incineration plant with SCR process (direct high-dust)
Figure 3:
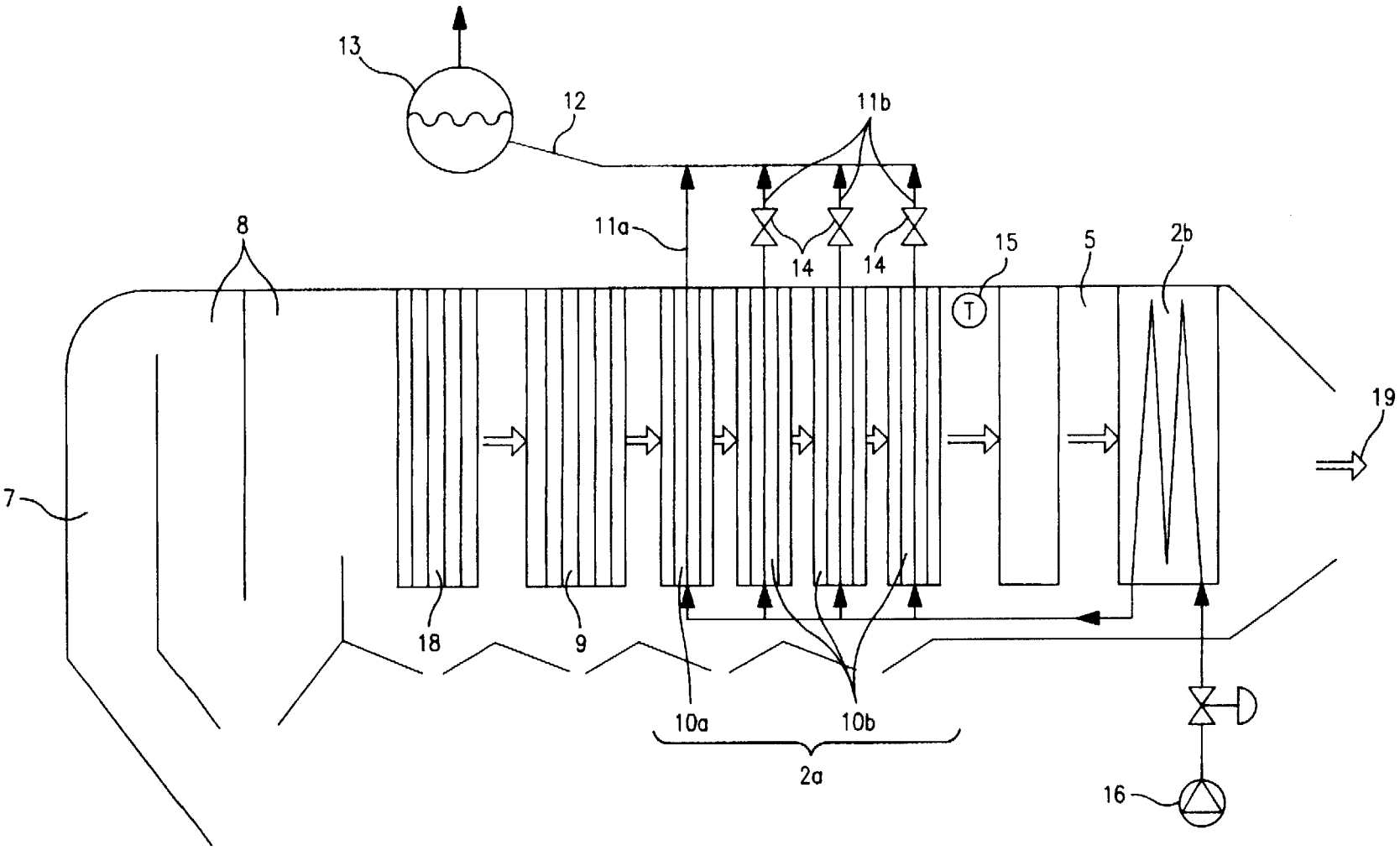
FIG. 3 shows a more detailed representation of part of FIG. 2 in the area of the boiler, the NOx catalyst and the economizer.

Since in the two last-mentioned cases, constant gas temperature cannot be ensured upstream of the NOx catalyst 5 for different operating states, the solution of the invention is employed, of which one embodiment is shown in FIGS. 2 and 3. The principle is that the steam generator 1 has a two-part economizer 2. This comprises a part 2*a*, which is arranged on the gas side upstream of the NOx catalyst 5, and a part 2*b*, which is arranged downstream of the NOx catalyst 5. In the circuit arrangement shown in FIG. 2, an electrostatic 3 and then a scrubber 4 precipitator are arranged downstream of the economizer, in the order in which gases flow through them. The temperature upstream of the NOx catalyst is virtually constant for various operating states (350° C. in the illustrative embodiment shown), it can vary by +/−10° C. The temperature constancy can be further improved (to +/−1°C.) if the flow or temperature of the feed water, which enters the economizer upstream of the catalyst 2*a*, is varied.

FIG. 3 shows a more detailed diagrammatic representation of the steam generator of the invention, as used in the high-dust circuit as in FIG. 2. Two vertical outlet flues 8, which form the radiant part of the steam generator, are arranged above a firebox 7. In the horizontal part of the steam generator following these, a superheater 9 and an economizer 2 subdivided into two main parts 2*a* and 2*b* are arranged in the order in which the flow passes through them, the NOx catalyst 5 which is required for the selective catalytic reduction of the nitrogen oxides being accommodated between the two parts 2*a*, 2*b*.

The pre-catalyst economizer 2*a* is subdivided into a plurality of separated sections 10 (here 4 sections), through which the flow passes in series on the gas side and through which the working medium, i.e. water, flows in parallel from bottom to top. These parallel connection lines 11 finally open into a line 12 which is connected to the drum 13. With one exception, a shut-off element 14, for example a valve, is arranged in all of the parallel lines 11 downstream of the individual sections 10 of the pre-catalyst economizer 2*a*, so that these sections can be shut off as desired from the water circulation, while a section 10 of the pre-catalyst economizer is in all cases connected to the drum 13, i.e. even when all other sections 10 are shut off.

The pre-catalyst economizer 2*a* is designed so that partial evaporation can occur. It is designed to be of a size such that in the operating case "full load, dirty", the entry temperature of the flue gas into the catalyst 5 is less than or equal to the operating temperature of the catalyst 5.

The components, such as superheater 9, contact heat generator 18 ("protective bundles", which are first impinged by the flue gas), outlet flues 8, in the steam generator 1 which are upstream of the pre-catalyst economizer 2*a* are designed so that, in the operating case "partial load, clean", the entry temperature of the flue gas into the pre-catalyst economizer is greater than or equal to the operating temperature of the catalyst.

A temperature measuring element 15 is arranged downstream of the section 10 which is last in the direction of gas flow. The second part of the economizer 2*b*, situated on the gas side downstream of the catalyst 5, is essentially implemented in a counter-current flow circuit. A pump 16 pumps water via the line 17 into the part 2*b* of the economizer which is arranged downstream of the NOx catalyst 5. The water cools the denitrated flue gases which exit from the catalyst 5 further downstream, before they are de-dusted in the filter 3 which is not depicted here and fed to the scrubber 4. The water is then passed by the catalyst 5 in parallel into the sections 10, and flows through them from bottom to top, a further heat exchange taking place with flue gas which is still hotter here. In order to ensure a virtually constant entry temperature of the flue gases into the NOx catalyst, the flue gas temperature is measured by the temperature measuring element 15. Depending on the level of this temperature, the flue gas temperature can be influenced by individual sections 10 of the pre-catalyst economizer 2*a* being able to be shut off from, or reconnected to, the water circulation by closing or opening the respective shut-off elements 14. This effects a change in the active heating surface area. The SCR process itself then runs according to the known prior art.

Obviously, the invention is not restricted to the illustrative embodiment just described. It can, for example, also be implemented in a steam generator having a vertical convective flue.

Figure 4:
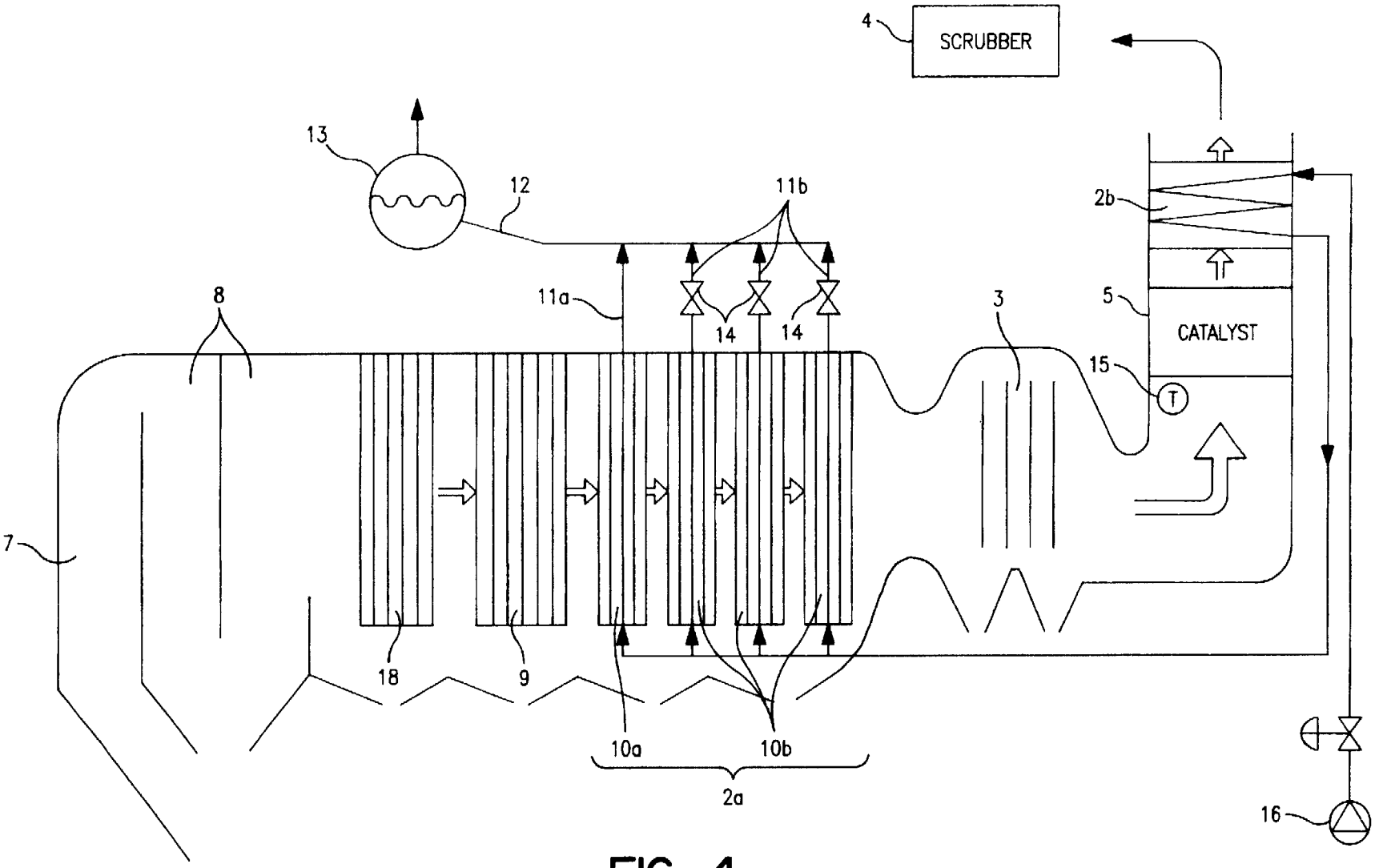
FIG. 4 shows a diagrammatic representation of the invention in the area of the boiler, the electrostatic precipitator, the NOx catalyst and the economizer (direct low-dust SCR process).

In FIG. 4, a steam generator of the invention is shown diagrammatically for the SCR low-dust process. Unlike FIG. 3, here, an electrostatic precipitator 3 is arranged between the pre-catalyst economizer 2*a* and the NOx catalyst 5. In addition, this illustrative embodiment shows that the post-catalyst economizer 2b can also be constructed with vertical gas flow. In a further variant not shown, the post-catalyst economizer 2b is also arranged at a greater spatial distance from the NOx catalyst.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United States is:

1. A steam generator for direct selective catalytic reduction (SCR process) of nitrogen oxides in a flue gas flow, comprising:

a radiant part connected to receive a flue gas flow from a fire box, a convective part connected downstream of the radiant part as a flow duct, the convective part including, in series in the flow duct, a contact heat exchanger, a superheater, and an economizer, wherein the economizer includes two parts, and an NOx catalyst arranged between the two parts of the economizer, wherein, a first part of the economizer upstream of the catalyst in the direction of flow of the flue gas is subdivided into at least two sections, the at least two sections positioned to contact the flue gas flow in series and, the at least two sections connected to receive a working medium in parallel flows, wherein a first section is connected on an outlet side by a line for continuous flow of the working medium to a drum and at least a second section is connected on an outlet side by a line having shut off means for controlled flow of the working medium to the drum.

2. The steam generator as claimed in claim 1, wherein the second section includes at least two subsections, each subsection having a line connecting to the drum, and wherein a shut-off element is arranged in each of the lines from the subsections to the drum, to selectively shut off the working medium flow to the drum.

3. The steam generator as claimed in claim 1, wherein the first economizer part upstream of the catalyst has a predetermined capacity for removing heat from the flue gas such that, in the operating case "full load, dirty", the flue gas is cooled sufficiently so that a temperature of the flue gas passing from the first economizer part into the catalyst is not greater than an operating temperature of the catalyst.

4. The steam generator as claimed in claim 1, wherein the superheater, contact heat generator, and outlet flues in the steam generator upstream of the first economizer part have a predetermined capacity for removing heat from the flue gas so that in the operating case "partial load, clean", an entry temperature of the flue gas into the first economizer part is not less than an operating temperature of the catalyst.

5. The steam generator as claimed in claim 1, further comprising an electrostatic precipitator arranged between the first economizer part and the NOx catalyst.

6. The steam generator as claimed in claim 1, wherein the flue gas flow and working medium flow pass through the second economizer part in a counter current circuit.

7. The steam generator as claimed in claim 1, wherein the flue gas flows vertically through the second economizer part.

8. The steam generator as claimed in 1, wherein the second economizer part is spatially separated from the NOx catalyst.

9. A process for operating a steam generator for direct selective catalytic reduction (SCR process) of nitrogen oxides in a flue gas flow, in which the steam generator comprises a radiant part connected to receive a flue gas flow from a fire box, a convective part connected downstream of the radiant part, the convective part including, in series on a flue-gas side, a contact heat exchanger, a superheater and an economizer, wherein the economizer includes two parts, and an NOx catalyst arranged between the two parts of the economizer, wherein, a first part of the economizer upstream of the catalyst in the direction of flow of the gas is subdivided into at least two sections, the at least two sections positioned to contact the flue gas in series on the flue-gas side and connected to receive a working medium to be heated in parallel flows, wherein at least a first section is connected by a line for continuous flow of the working medium to a drum and a second section is connected by a line having shut off means for controlled flow of the working medium to the drum, the method comprising the steps of:

measuring a temperature of the flue gas immediately prior to entry into the NOx catalyst and responsive to the measured temperature closing the shut-off means connecting the second section to the drum to adjust a heat exchange capacity of the economizer.

10. The process as claimed in claim 9, wherein the temperature of the flue gas upstream of the NOx catalyst is controlled to be greater than an evaporation temperature of the working medium at boiler pressure.

* * * * *